United States Patent [19]

Persson

[11] 4,006,992

[45] Feb. 8, 1977

[54] FILE

[76] Inventor: Sven-Olof Ingemar Persson, Fredmans Grand 6, 644 00 Torshalla, Sweden

[22] Filed: Mar. 5, 1976

[21] Appl. No.: 664,354

[30] Foreign Application Priority Data

Mar. 7, 1975 Sweden ..... 7502566

[52] U.S. Cl. ..... 402/47; 24/248 SL

[51] Int. Cl.[2] ..... B42F 13/32

[58] Field of Search..... 24/248 SL, 249 SL; 35/19 R; 402/26, 28, 46, 47, 48, 74, 80 R, 42, 54

[56] References Cited

UNITED STATES PATENTS

| | | | |
|---|---|---|---|
| 389,530 | 9/1888 | Schlicht | 402/47 |
| 720,975 | 2/1903 | Schult | 402/47 |

FOREIGN PATENTS OR APPLICATIONS

| | | | |
|---|---|---|---|
| 5,920 | 11/1901 | Germany | 402/47 |
| 489,229 | 1/1954 | Italy | 402/42 |
| 1,078,940 | 8/1967 | United Kingdom | 402/47 |
| 8,279 | 4/1906 | United Kingdom | 402/47 |

*Primary Examiner*—Harland S. Skogquist
*Attorney, Agent, or Firm*—Wenderoth, Lind & Ponack

[57] ABSTRACT

A file for holding perforated sheets is provided adjacent its spine with a pair of spaced apart tubular prongs for cooperation with the sheet perforations. The file is provided at its spine with a leaf spring of which a portion protruding from the inner side of the spine, in the position of use of the file, abuts against the web of a substantially U-shaped wire member, the arms of which engage the tubular prongs to retain the sheets to the tubular prongs. The leaf spring portion protruding from the spine to cooperate with the web of the U-shaped wire member has a tongue integral with the protruding leaf spring portion and directed towards the spine of the file. When the protruding leaf spring portion is caused to abut against the web of the U-shaped wire member, the tongue snaps home under the wire to lock the leaf spring to the U-shaped wire member.

5 Claims, 7 Drawing Figures

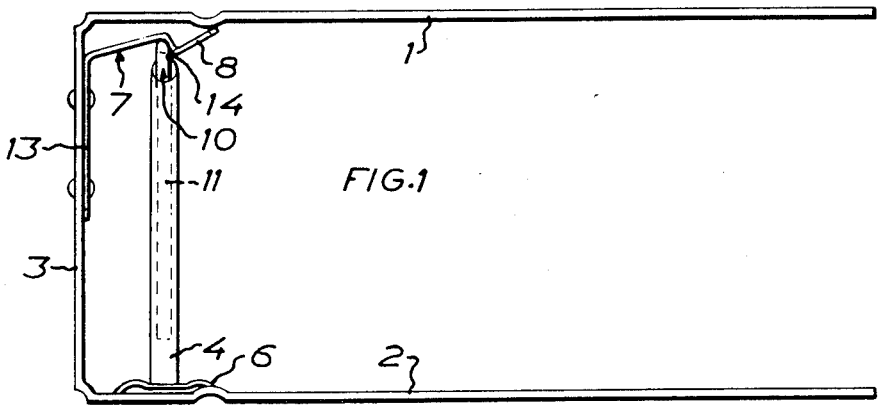
FIG.1
FIG.2
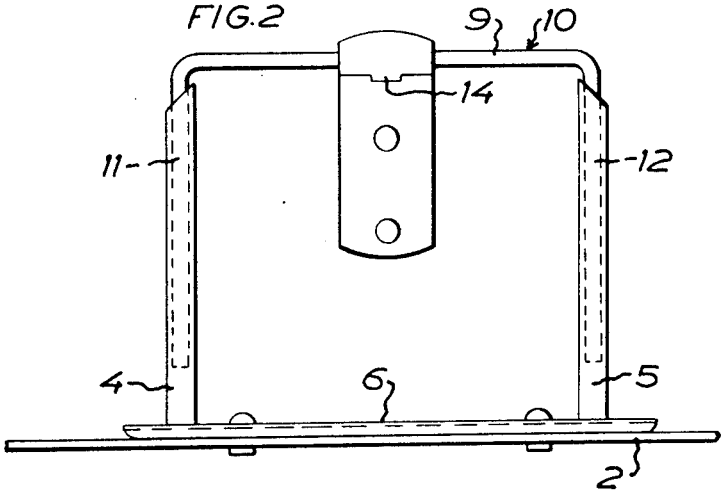
FIG.3
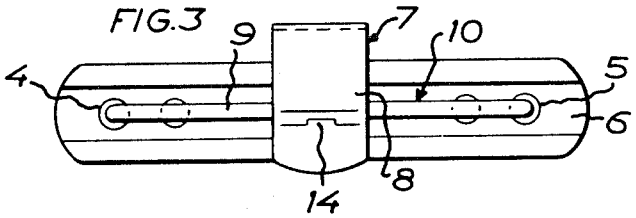

FILE

The present invention relates to a file for holding perforated sheets, which file is provided adjacent its spine with a pair of spaced apart tubular prongs for cooperation with the sheet perforations and at its spine with a leaf spring of which a portion protruding from the inner side of the spine, in the position of use of the file, abuts against the web of a substantially U-shaped wire member, the arms of which engage the tubular prongs to retain the sheets to the tubular prongs. A file of this type, having been widely used for archival purposes over several decades, suffers from a considerable disadvantage in that the connection between the leaf spring and the U-shaped wire member has not proved satisfactory, since it often comes loose unintentionally with ensuing negative effects. This drawback is overcome by providing a file according to the present invention, wherein the leaf spring portion protruding from the spine to cooperate with the web of the U-shaped wire member, has a tongue integral with the protruding leaf spring portion and directed towards the spine of the file, which tongue, when the protruding leaf spring portion is caused to abut against the web of the U-shaped wire member, is adapted to snap home under the wire in order to lock the leaf spring to the U-shaped wire member. The tongue which thus brings about an efficient connection between the leaf spring and the U-shaped wire member, can be obtained at the same time as the spring is bent, without having to neglect the requirement of resiliency in the leaf spring. Thus, it has become possible to obtain effective locking by a simple and inexpensive means.

Embodiments of the invention will be described below in greater detail with reference to the accompanying drawings in which:

FIG. 1 is an elevation of the file in recumbent position and as seen from the bottom edge, with part of the back cover broken away;

FIG. 2 is a front elevation of the file mechanism in the recumbent position of the file;

FIG. 3 is a top plan view of the same mechanism;

Figure 4:
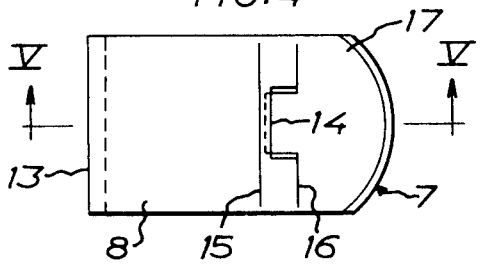
Figure 5:
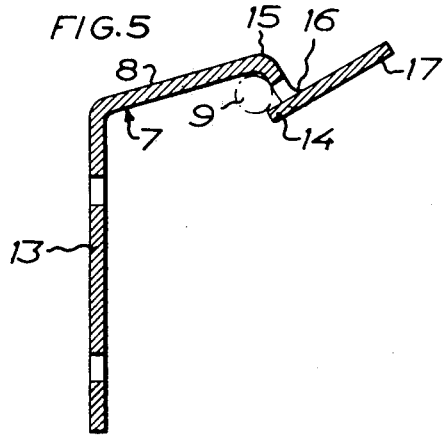
Figure 6:
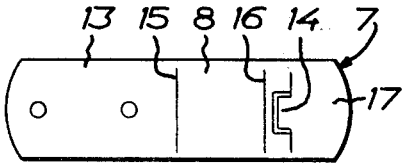

FIGS. 4 and 5, on a larger scale, are respectively a top plan view and a section on line V—V in FIG. 4 of the leaf spring being part of the same mechanism;

FIG. 6 is a developed plan view of the leaf spring; and

Figure 7:
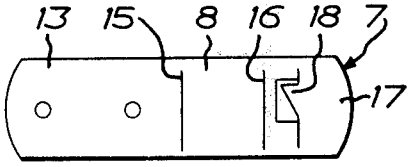

FIG. 7 is a developed plan view of a modified embodiment of the leaf spring.

With reference to the drawings, the file comprises a front cover 1, a back cover 2 and a spine 3. These parts are formed from a single blank of paperboard, plastics or like material, preferably provided with crease lines. Adjacent the spine 3 the back cover 2 of the file has a pair of spaced apart tubular prongs 4 and 5 for cooperation with the perforations of the sheets. The tubular prongs 4 and 5 are riveted to a plate 6 which, in turn, is riveted to the back cover 2. At the spine 3 the file has a leaf spring 7 which, in the position of use of the file, is adapted, with a portion 8 protruding from the inner side of the spine 3, to abut against the web 9 of a substantially U-shaped wire member 10, the arms 11 and 12 of which engage the tubular prongs 4 and 5 to produce retention of the sheets to the tubular prongs 4 and 5. A portion 13 of the leaf spring 7 abuts on the spine 3 of the file to which it is riveted.

According to the invention, the protruding portion 8 of the leaf spring 7 is formed with a tongue 14 integral with the portion 8 and directed towards the spine 3 of the file. As the portion 8 is caused to abut against the web 9 of the U-shaped wire member 10, the tongue 14 is adapted to snap home under the wire to lock the leaf spring 7 to the U-shaped wire member 10.

The protruding portion 8 of the leaf spring 7 has an inner downward bend 15 and an outer upward bend 16. The leaf spring zones adjoining the bend 15 are adapted to abut against the web 9 of the member 10, the leaf spring portion 17 located beyond the outer bend 16 forming a finger grip for opening the file mechanism. The tongue 14 integral with the protruding portion 8 and oriented towards the spine 3 is a direct extension of the finger grip 17 and projects a short distance beyond the bend 16 towards the spine. At the formation of the bend 16, the tongue 14, already punched out, is left unaffected. In addition, when the spine 3 is pivoted to the service position of the file, the portion 17 is adapted to guide the leaf spring 7 towards the web 9 of the U-shaped wire member 10 to locking position.

In the embodiment according to FIGS. 1 to 6, the tongue 14 is positioned at the centre line of the protruding portion 8 and is substantially symmetric with respect to that line. As appears from the drawings, the tongue is rectangular but it may also be for instance arcuate or triangular.

In the modified embodiment shown in FIG. 7, the length of the tongue 18 increases from one side thereof to the other, the length increase preferably being rectilinear, departing from zero. Furthermore, the tongue 18 is disposed beside the centre line of the portion 8, the tongue 18 being positioned at the side of the centre line towards which the length of the tongue increases. By each one of these measures the leaf spring 7 can, upon actuation of the finger grip 17, be readily removed from the file locking position in which the tongue 18 reaches underneath the web 9 of the U-shaped wire member 10. This can be achieved only if the tongue 18 is of an appropriate length with regard to its function, it being easiest to determine its length empirically.

The invention is not restricted to that described above and shown in the drawings, but may be modified within the spirit and scope of the accompanying claims.

What I claim and desire to secure by Letters Patent is:

1. A file for holding perforated sheets, which file is provided adjacent its spine with a pair of spaced apart tubular prongs for cooperation with the sheet perforations and at its spine with a leaf spring of which a portion protruding from the inner side of the spine, in the position of use of the file, abuts against the web of a substantially U-shaped wire member, the arms of which engage the tubular prongs to retain the sheets to the tubular prongs, wherein the leaf spring portion protruding from the spine to cooperate with the web of the U-shaped wire member, has a tongue integral with the protruding leaf spring portion and directed towards the spine of the file, which tongue, when the protruding leaf spring portion is caused to abut against the web of the U-shaped wire member, is adapted to snap home under the wire in order to lock the leaf spring to the U-shaped wire member.

2. A file as claimed in claim 1, wherein the protruding leaf spring portion which is adapted to abut, with zones adjoining a bend thereof, against the web of the U-shaped wire member, forms a finger grip beyond an additional outer bend thereof, said tongue integral with said protruding portion and directed towards the spine forming a direct extension of said finger grip and projecting a short distance beyond said additional bend towards the spine.

3. A file as claimed in claim 1, wherein said tongue is positioned at the centre line of said protruding portion and is substantially symmetric with respect to said line.

4. A file as claimed in claim 1, wherein said tongue is of a length increasing from one side of the tongue towards the other.

5. A file as claimed in claim 4, wherein said tongue is positioned beside the centre line of said protruding portion, preferably at the side of said centre line towards which the length of the tongue increases.

* * * * *